US005255805A

United States Patent [19]

Weiss et al.

[11] Patent Number: 5,255,805

[45] Date of Patent: Oct. 26, 1993

[54] SCREW CAP

[75] Inventors: Jürgen Weiss; Hans D. Dubs, both of Worms; Hans J. Preuss, Monsheim, all of Fed. Rep. of Germany

[73] Assignee: Alcoa Deutschland GmbH, Worms, Fed. Rep. of Germany

[21] Appl. No.: 681,491

[22] PCT Filed: Sep. 27, 1989

[86] PCT No.: PCT/EP89/01129

§ 371 Date: May 10, 1991

§ 102(e) Date: May 10, 1991

[87] PCT Pub. No.: WO90/03924

PCT Pub. Date: Apr. 19, 1990

[30] Foreign Application Priority Data

| | | | |
|---|---|---|---|
| Oct. 5, 1988 | [DE] | Fed. Rep. of Germany | 3833945 |
| Mar. 25, 1989 | [DE] | Fed. Rep. of Germany | 3909857 |
| May 25, 1989 | [DE] | Fed. Rep. of Germany | 3916958 |
| Aug. 23, 1989 | [DE] | Fed. Rep. of Germany | 3927793 |

[51] Int. Cl.[5] ..... B65D 41/04; B65D 45/30; B65D 53/02

[52] U.S. Cl. ..... 215/274; 215/227; 215/252; 215/258; 215/329; 215/346; 215/352

[58] Field of Search ..... 215/276, 227, 252, 258, 215/274, 317, 321, 334, 335, 329, 331, 346, 341, 352

[56] References Cited

U.S. PATENT DOCUMENTS

| | | | |
|---|---|---|---|
| 2,744,647 | 5/1956 | Wheaton et al. | 215/341 X |
| 3,603,472 | 9/1971 | Lecinski, Jr. et al. | 215/335 X |
| 3,677,431 | 7/1972 | Westfall | 215/335 X |
| 3,746,199 | 7/1973 | Hart et al. | 215/346 X |
| 3,899,096 | 8/1975 | Marco | 215/31 |
| 4,511,053 | 4/1985 | Brandes et al. | 215/252 |
| 4,597,501 | 7/1986 | Gueret | 215/330 |
| 4,679,696 | 7/1987 | Bonnenfant et al. | 215/252 |
| 4,875,594 | 10/1989 | Ochs | 215/252 |
| 5,020,679 | 6/1991 | Signorini | 215/335 X |
| 5,103,991 | 4/1992 | Collins | 215/329 |
| 5,105,961 | 4/1992 | Norén et al. | 215/345 |

FOREIGN PATENT DOCUMENTS

| | | |
|---|---|---|
| 2226906 | 12/1972 | Fed. Rep. of Germany . |
| 8220978 | 2/1983 | Fed. Rep. of Germany . |
| 3722603C1 | 7/1988 | Fed. Rep. of Germany . |

OTHER PUBLICATIONS

European Search Report, dtd. Jan. 16, 1990.

English Translation of International Search Report, dtd. Jan. 19, 1990.

*Primary Examiner*—Allan N. Shoap

*Assistant Examiner*—Vanessa Caretto

*Attorney, Agent, or Firm*—Staas & Halsey

[57] ABSTRACT

A screw cap for a container that has a thread, in particular bottles, jars, and the like. A ring that incorporates at least one projection engages the thread on the container. The ring can be configured as a safety ring, i.e., that it have a lower ring section that incorporates barbs that extend from a perpendicular wall area. When the container is first opened, the barbs engage under projections on the container and burst the lower ring section off. The cap of the screw cap need incorporate no threads of any kind because of the projections of the ring.

7 Claims, 13 Drawing Sheets

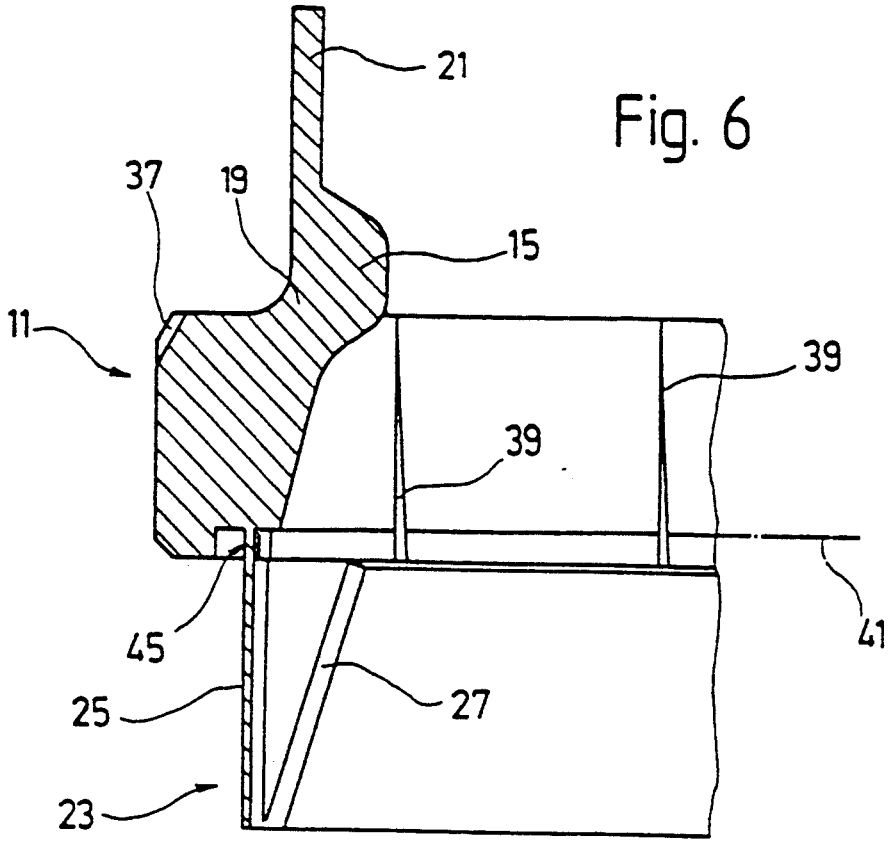
Fig. 6
Fig. 7
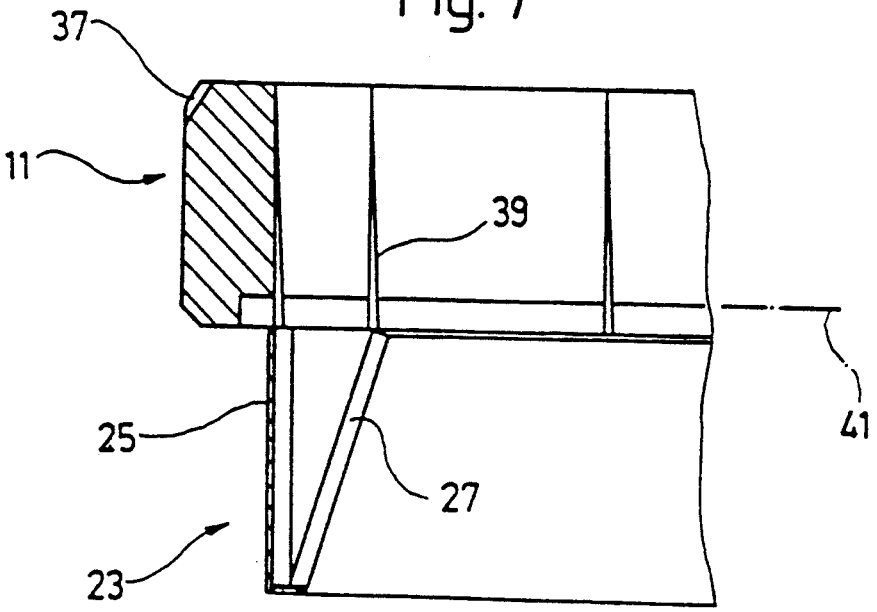

Fig. 9
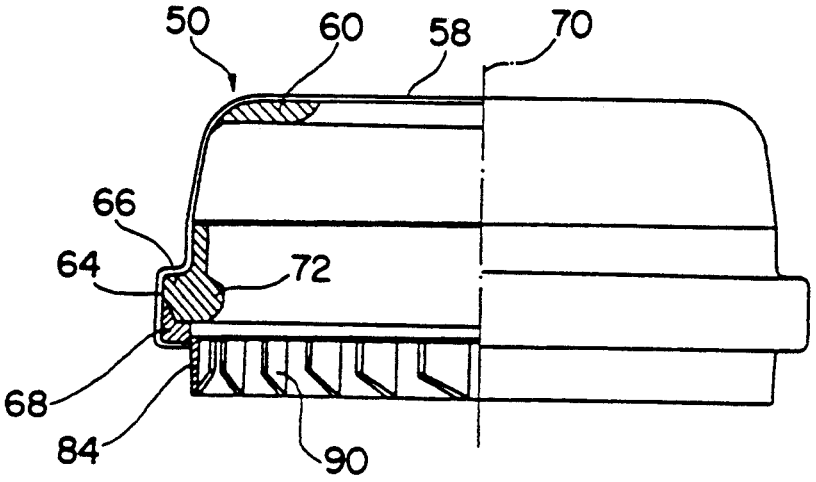
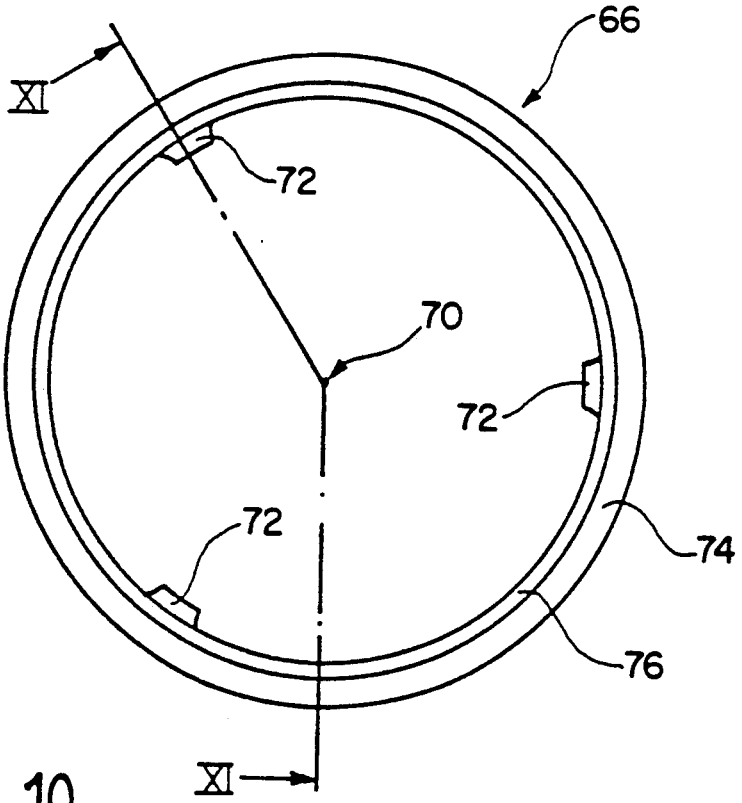
Fig. 10

Fig. 12
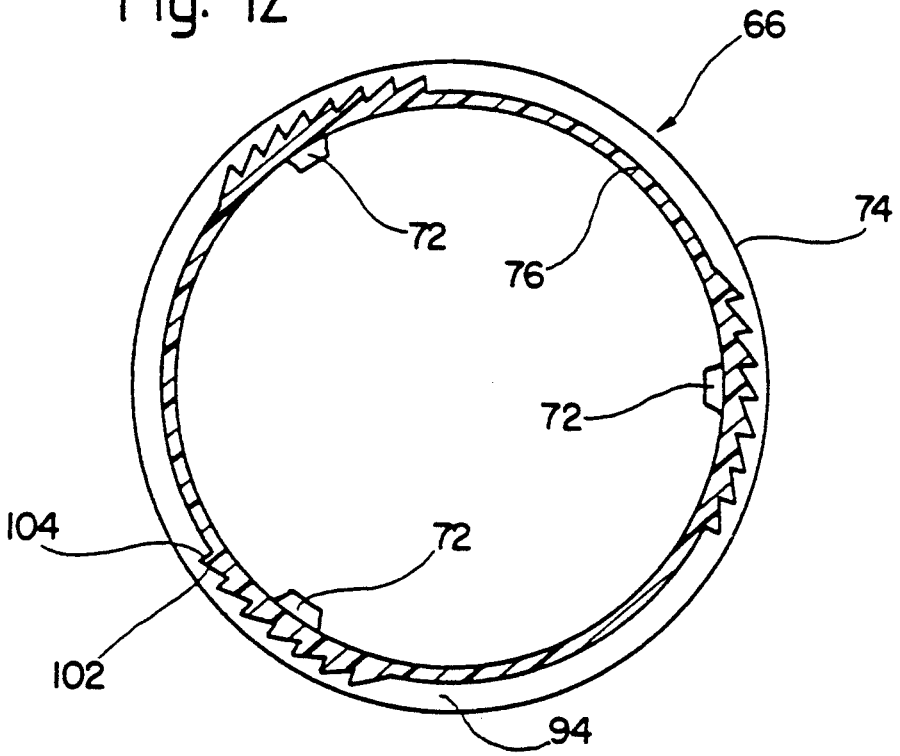
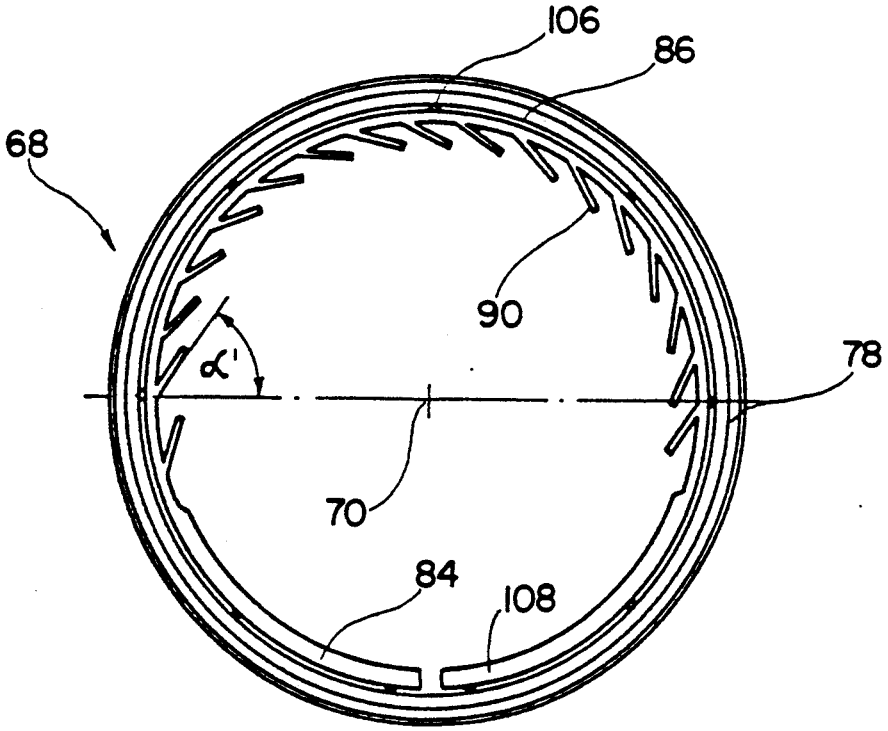
Fig. 13

Fig. 18
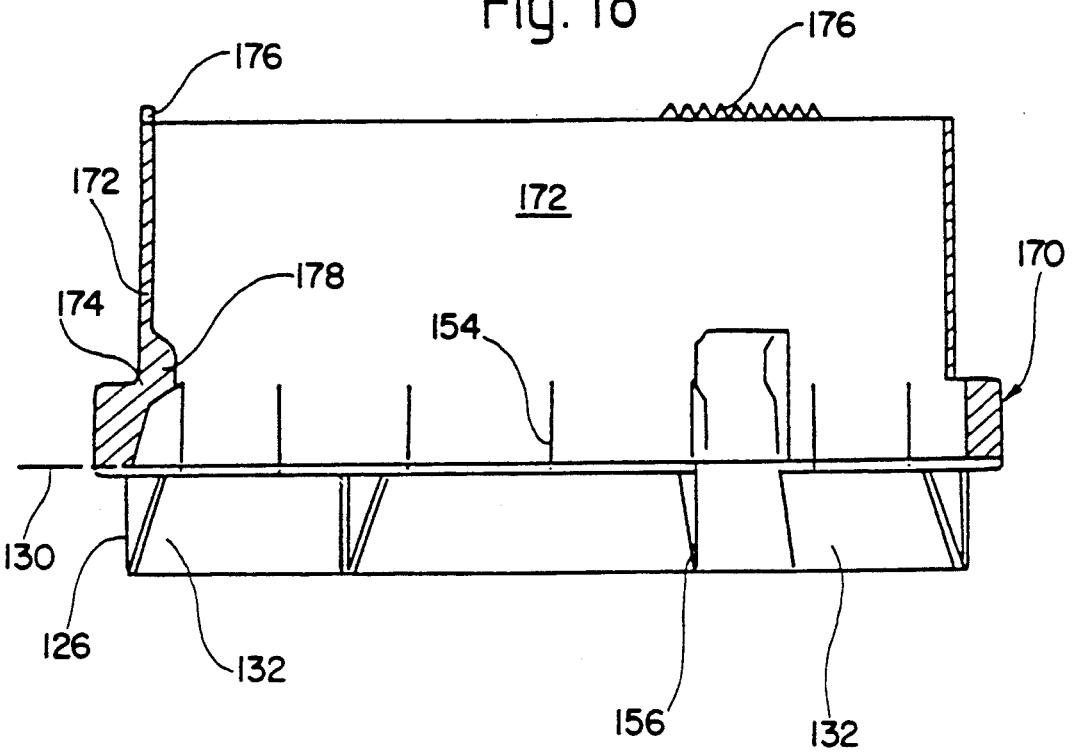
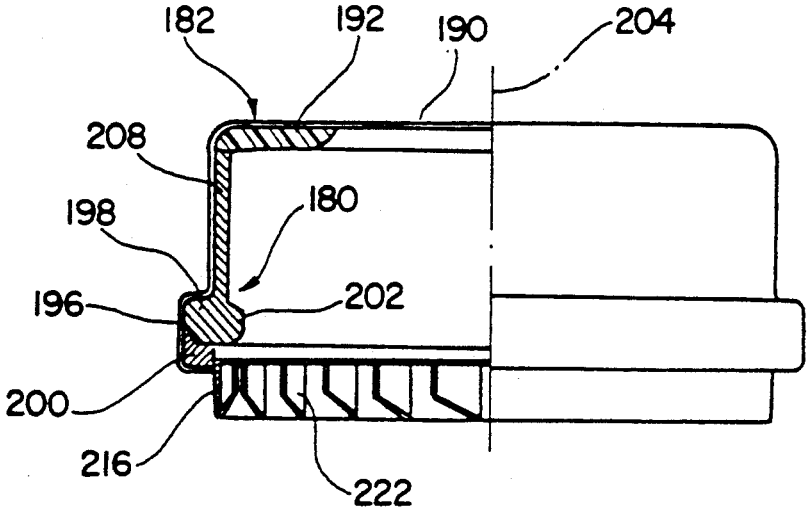
Fig. 19

SCREW CAP

The present invention relates to a screwcap for containers, particularly, the present invention relates to a screw cap for a container that has a thread, including a ring held by the screw cap and at least one projection that engages the thread of the container and which forms the "thread" of the screw cap.

Screw caps of the type described herein are used for containers, in particular for bottle, and for glass jars for liquids, pastes, or bulk material. The containers have a thread in the area of their opening or mouth, and this can also consist, for example, of short thread sections. Threads of this type are referred to as twist-off threads.

The screw caps that are intended for use with this type of container have a cap that is provided with a thread that engages with the thread on the container. The containers can be provided with, a continuous thread or with projections that form the thread. In particular, in the case of short thread sections, it is not necessary that these have a pitch. Threads of this kind that are used, for example, to close marmalade or jam jars, are also referred to as twist-off threads. In containers with twist-off threads, the cap has projections that work in conjunction with the thread sections on the container.

In the case of screw caps that are produced from material that can be deep drawn, for example, from aluminum or steel, the thread of the cap which engages with the thread on the container must be produced by deformation of the side walls of the cap. In conventional caps, the thread is frequently produced by a so-called rolling process. To this end, a cap blank without a thread is set on the already filled container and the outer wall of the screw cap is so pressed in by using a suitable apparatus that a thread that matches the thread on the container is produced in the screw cap. However, this can damage the container, in particular in the case of glass containers, as parts of the thread section can splinter off and get into the interior of the container. This can be dangerous for the user.

SUMMARY OF THE INVENTION

Thus, it is the task of the present invention to create a screw cap for a container that incorporates a thread, in which any damage to the container is avoided. In addition, the "thread" used for the screw cap should be simple and economical to produce. Furthermore, the forces necessary to open the cap should be transferred safely to the ring for a container that has a thread, including a ring held by the screw cap, said ring having at least one projection that engages the thread of the container and which forms the "thread" of the screw cap.

Because of the fact that the screw cap incorporates a ring, which in turn incorporates at least one projection that engages in the thread on the container, it is no longer necessary to provide the screw cap itself, which is to say the cap element of the screw cap, with a thread. This precludes the risk of any damage being done to the container and it becomes impossible for the user to be endangered, for example, by splinters of glass.

In a particularly preferred embodiment of the screw cap, the projection is arranged on a tab that merges into a standoff strip. This is so arranged between the cap of the screw cap and the container that is to be closed that the screw cap is properly centered. This ensures the reliable functioning of the projection of the ring "thread".

In order to make the engagement of the projections particularly reliable, in a preferred embodiment of the screw cap a standoff strip is arranged opposite a projection. This itself can incorporate a projection. In such a configuration of the screw cap forces that are so high can be ensured such that proper opening and closing of the container with the help of the screw cap is ensured.

Particularly preferred is a screw cap in which the ring is configured as a safety ring. This has at least one area which is permanently deformed or destroyed when the container is first opened. Such a safety ring ensures that the user can check whether the container has been opened previously. In this way, the user can be quite sure that he has an intact container in his hands.

The present invention also relates to a screw cap for a container that has a thread including a ring held by the screw cap and having at least one projection that engages the thread of the container and which forms the "thread" of the screw cap, wherein the ring is configured as a safety ring and incorporates at least one area that remains permanently deformed when the container is first opened, and wherein the ring incorporates an upper first ring element that bears the at least one projection and a lower ring element on which the safety ring is installed, and wherein the upper and the lower ring elements are configures as separate rings.

The division of a ring into an upper first ring element and into a lower second ring element makes it particularly easy to produce these in an injection molding process, using plastic. In particular, it is ensured that removal of the ring elements from the mold is particularly easy. Because of the division of the ring into two parts, various materials can be selected for the upper and the lower ring elements. This makes it possible to take into account the particular stresses on these elements.

It is preferred that the upper and the lower ring elements be joined to each other by friction and/or shape fit, by welding, or by adhesion. This results in an optimal functional unit from the two ring elements.

A preferred embodiment of the screw cap is characterized in that a form fit is produced between the ring elements, this ensuring that the two ring elements hook into each other during relative movement of the two elements towards each other. This also results in an optimal functional relationship between the two elements. In addition, a screw cap is preferred, in which an annular wall that incorporates form-fit means is provided on the one ring element and on the other ring element there is a second annular wall which incorporates form-fit means on its outer side. When this is done, the inside diameter of the first annular wall is so matched to the outside diameter of the second annular wall that their form-fit means engage with each other. Such a configuration of the two ring elements results in a particularly large engagement surface between the two elements.

A further configuration is characterized in that the annular walls of the ring elements are conical and are so matched to each other that automatic centering of the two ring elements takes place when the cap is being assembled.

The form-fit means can be produced particularly simply if they incorporate saw-tooth projections. It is preferred that these be so oriented that they latch with each other when the ring elements are rotated, thereby ensuring optimal force transfer.

It is preferred that the ring elements be provided with an annular bead on their outer side, this being arranged in an annular groove in the cap. A construction of this type also ensures efficient transfer of force between the elements. In those cases where only a small amount of force has to be transferred, in a screw cap of this kind it is possible to dispense with a form-fit between the ring elements. It is then sufficient to provide for only a friction fit.

Also preferred is a screw cap in which the safety ring incorporates at least one bridge piece on its inner side, this bridge piece projecting towards the midline axis of the safety ring and engaging in a recess on the outer surface of the container when the cap is rotated as the container is opened. Thus, when the screw cap is rotated, any rotation of the safety ring is prevented by the latching of the bridge pieces with the container. This means that the safety ring is sheared off from the ring or from the associated ring elements, the lower ring element.

Particularly preferred is an embodiment of the screw cap in which the bridge pieces subtend an angle with the line that intersects their origin, and runs through the midline axis of the safety ring, this angle lying in the range between 5° to 85°, especially from 20° to 70°, and in particular in the range from 35° to 55°. Such an orientation of bridge pieces ensures on the one hand the secure latching with the recess on the outer surface of the container. On the other hand, when the screw cap is rotated, the bridge pieces are tilted and this leads to an expansion or enlargement of the safety ring. The result of this is that the retaining webs between the safety ring and the ring or the lower ring element that form the nominal break line are stressed not only in the peripheral direction by the latching of the bridge pieces, but also in a radial direction. This double stressing of the retaining webs leads to a particularly rapid and easy separation of the nominal break line.

It is preferred that the screw cap is so configured that the thickness of the bridge pieces is so selected that they act as spring elements and press elastically against the outer surface of the container that is to be closed. A construction of this type provides for optimal balancing out of tolerance differences both on the outer surface of the container and also with reference to the diameter of the cap or the safety ring. In any case, it is ensured that the bridge pieces are adjacent to the outer side of the container under tension and thus engage properly in the associated recess.

In a particularly preferred embodiment of the cap, there is a tear line or recess of the casing surface of the safety ring. The bridge pieces are arranged over a large area of the periphery of the safety ring. However, the area with the tear line is free of bridge pieces of this kind. This ensures that the safety ring is not forced outwards by the bridge pieces that are under tension in this weakened area, since this would provide a false indication that the container had been opened.

The present invention also relates to a screw cap for a container that has a thread including a ring held by the screw cap and having at least one projection that engages the thread of the container and which forms the "thread" of the screw cap, wherein the ring is provided with at least one detent projection that extends in the direction of a bottom of the screw cap that works in conjunction with a blocking element that is arranged in the area of the bottom of the cap so as to be incapable of rotating.

It is particularly advantageous that the ring engages with a blocking element in the bottom area of the cap through a detent projection, so that when the cap is rotated it is ensured that the ring is also rotated. To this end, the blocking element is connected to the cap so as to rotate with it.

Also preferred is an embodiment in which the blocking element is configured as a ring in the transition area between the base and the side wall. The production of such a blocking element is particularly simple and, for this reason, cost effective.

In a development of the screw cap, the blocking element is configured as a part of the seal that is arranged in the bottom area of the cap. Since a seal is provided on the bottom of the container, it is particularly simple to provide a blocking element of this kind.

In addition, an embodiment of the screw cap in which the detent projection is configured as an annular casing area is also preferred, said casing area extending from the upper side of the ring and engaging with the blocking element at its upper edge. A cap of this kind is characterized in that a good force fit between the ring and the cap is ensured and in addition the friction between the cap and the container is greatly reduced. For all practical purposes, there is no possibility of the screw cap becoming stuck on the container threads, even if the contents of the container contain sugar.

Finally, a preferred embodiment of the screw cap is one in which the detent projection that is formed as a continuous annular casing incorporates at least one area that is provided with teeth that can engage with the blocking element. In a screw cap of this kind, an effective force fit between the ring and the cap is ensured.

BRIEF DESCRIPTION OF THE DRAWINGS

The present invention will be described in greater detail below on the basis of the various embodiments shown in the drawings appended hereto. By way of an example, a safety ring is shown as incorporating a section that breaks off when the container is first opened. These drawings show the following:

FIG. 6: a further enlarged partial view of the ring in cross section on the line VI—VI in FIG. 3;

FIG. 7: an enlarged drawing of a further area of the ring in cross section on the line VII—VII in FIG. 3;

FIG. 9: a partial view through a screw cap, without the container;

FIG. 10: a plan view of the upper ring element of the ring of the screw cap;

FIG. 12: a cross section on the line XII—XII in FIG. 11, perpendicular to the midline axis of the upper ring element;

FIG. 13: a view from below of a lower ring element of the ring of a screw cap;

FIG. 18: a cross section through a further embodiment of a ring of a screw cap as in FIG. 16;

FIG. 19: a cross section through another embodiment of a screw cap installed on a container;

In the screw cap according to the present invention, the cap can be of a resistant, stable plastic or a deep drawn material such as aluminum or steel. It is preferred that the threaded ring be of an elastic material such as plastic.

DESCRIPTION OF THE PREFERRED EMBODIMENT

Figure 1:
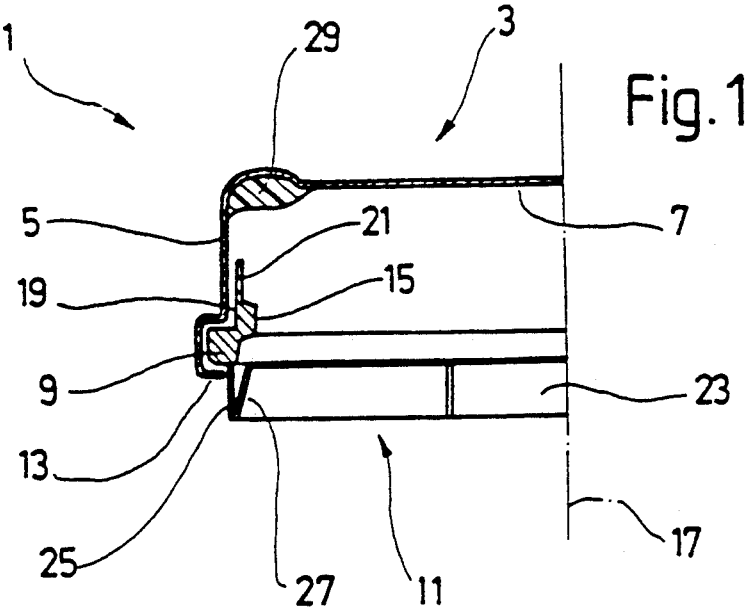
FIG. 1: a screw cap with a ring configured as a safety ring.

FIG. 1 shows a screw cap 1 in cross section. This screw cap 1 incorporates a metallic cap element 3 that is essentially dished. The side wall 5 of the cap element 3 has on its edge that is remote from the bottom 7 an annular bead 9 that encloses, at least in part, a ring 11. The ring 11 is installed in an annular groove defined by the annular bead 9. The outer edge of the cap element 3 is so beaded over that the ring 11 is held securely in the annular groove of the annular bead 9 by a beaded edge 13.

Here, the ring 11 incorporates in its upper edge area at least one projection 15 that projects towards the midline axis 17 of the screw cap 1 or of the ring 11, respectively. The projection extends from a tab or bridge piece 19 that merges into a standoff strip 21 in its upper area that is proximate to the bottom 7 of the cap element 3.

The projection 15 of the ring 11 meshes with a thread or individual detent or thread projections that are incorporated on the container that is to be closed. The projection is thus serves the function of the "thread" on the screw cap 1, which incorporates no other thread. In particular, the side wall of the cap element 3 is so configured as to be flat as far as the annular bead 9.

In the embodiment shown in FIG. 1, the ring 11 is in the form of a safety ring and incorporates a lower ring section 23 that is essentially V-shaped in cross section. A barb 27 that projects inwards and upwards and which forms a truncated conical casing extends from a side wall 25 of the lower ring section. The barb 27 is essentially flush with the inner surface of the ring 11 that lies in the annular groove formed in the annular bead 9, and can engage beneath a projection or the lower thread projection of the container. The barb 27 can be configured as a continuous area of the wall 25, although it can also consist of individual segments.

The screw cap 1 shown in FIG. 1 incorporates a seal insert 29 in the transition area between the bottom 7 and the side wall 5 of the cap element 3.

Figure 2:
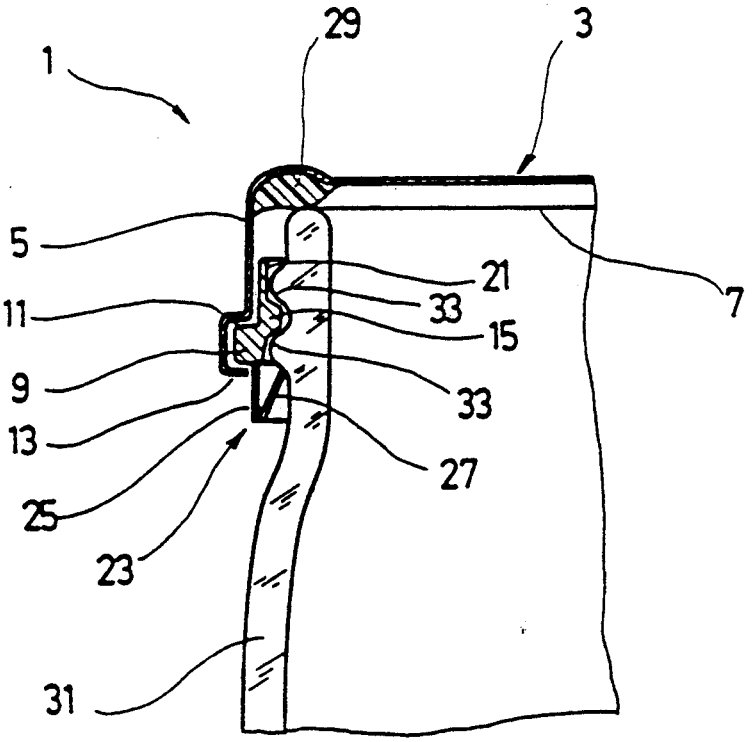
FIG. 2: a screw cap installed on a container.

FIG. 2 shows a screw cap 1 with a ring 11 that has been installed on a container 31. This container 31 can be, for example, a glass bottle or a glass jar such as is used for jams. Identical parts bear the identical reference numbers so that a detailed description can be dispensed with.

It can be seen from this drawing that when the screw cap 1 has been screwed onto the container 31, the projection 15 of the ring 11 engages the thread 33 on the container 31. The standoff strip 21 lies between the side wall 5 of the cap 3 and the thread 33 on the container 31, and serves to center the ring 11 within the thread 33 of the container 31. This ensures a secure engagement of the projection 15, which serves as a "thread" knob, in the thread 33 of the container 31. It is of no consequence whether the thread 33 is a continuous thread or individual thread sections or detent projections on the outside, in the neck area of the container 31.

FIG. 2 also shows that the barb 27 of the lower ring section 23 engages beneath the lower thread 33 or under a suitable projection or lug provided on the neck of the container 31. It is preferred that the barb 27 be sprung, so as to ensure secure engagement.

It is plain to see that the screw cap 1 can be screwed firmly onto the container 31 and screwed off this even though the cap element 3, and in particular its side wall 5, incorporate no thread of any sort. The function of a thread is assumed by the projection 15 of the ring 11.

When the screw cap 1 is first opened, the barb 27 hooks beneath the lowest thread of the container 31, so that the lower ring section 23 is torn or sprung off the ring 11. The lower ring section 23 is connected to the remaining part of the ring 11 through a nominal break line, as will be described in greater detail below.

Figure 3:
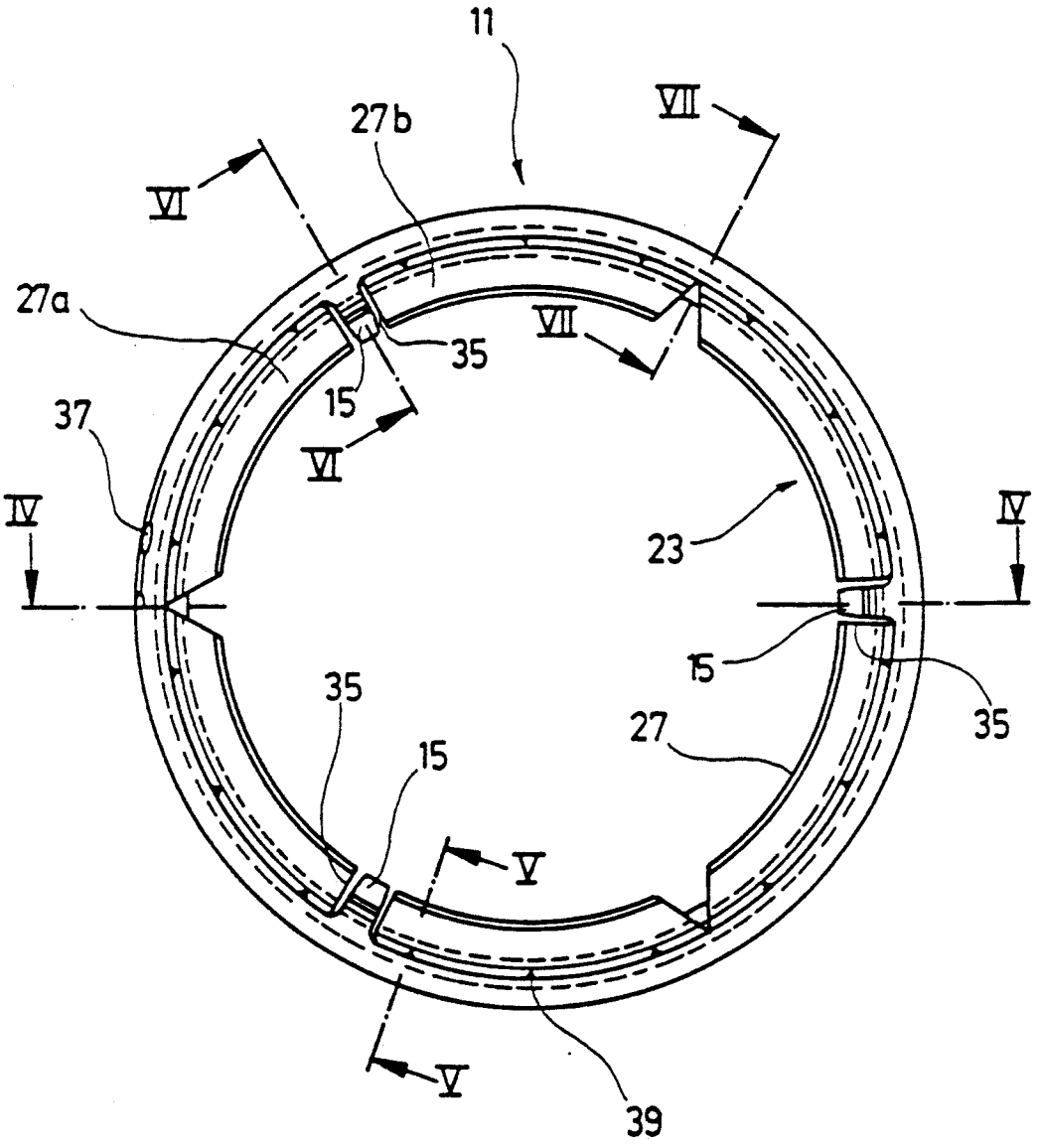
FIG. 3: a ring configured as a safety ring, in plan view.

FIG. 3 shows the enlarged ring 11 in plan view, as viewed from the underside 5 of the cap element 3. Identical parts bear identical reference numbers, so that a detailed description can be dispensed with.

The portion of the upper ring section of the ring 11 that lies in the annular groove that is enclosed by the annular bead 9, forms the outer limiting surface of the ring 11. The projections 15, that are formed on bridge pieces 19 (see FIG. 1 and FIG. 2) that extend from this upper ring section project into the interior of the upper ring section, and can thus engage with a thread 33 on the container 31.

The embodiment shown in FIG. 3 incorporates three projections 15 that serve as "threads". The segments 27*a* and 27*b* of the barb 27 of the lower ring section 23, which are adjacent to the projections 15, end in V-shaped cuts in the barb 27. The projections 15 are spaced equidistantly around the periphery of the ring 11, which is to say at intervals of 120°. Within the area of the projections 15, there are cuts 35 in the wall area of the lower ring section 23. The segments 27*a* and 27*b* of the wall area of the lower ring section 23 that serve as barbs, also project into the interior of the ring 11. It is preferred that these be so configured as to be sprung, so that they abut on the outer wall of the container 31 and engage securely beneath the corresponding thread 33 on the container.

The outer edge of the ring 11 incorporates depressions 37 that increase the amount of friction between the cap element 3 and the ring 11 so that a secure form closure is ensured. It is ensured that when the cap element 3 is rotated the ring 11 moves with it and can properly assume the "thread" function of the screw cap 1.

FIG. 3 shows tear bars 39 that connect the part of the ring 11 that is within the annular groove and the lower ring section 23, thereby forming a nominal break line 41.

This will be described in greater detail below on the basis of the subsequent drawings.

Figure 4:
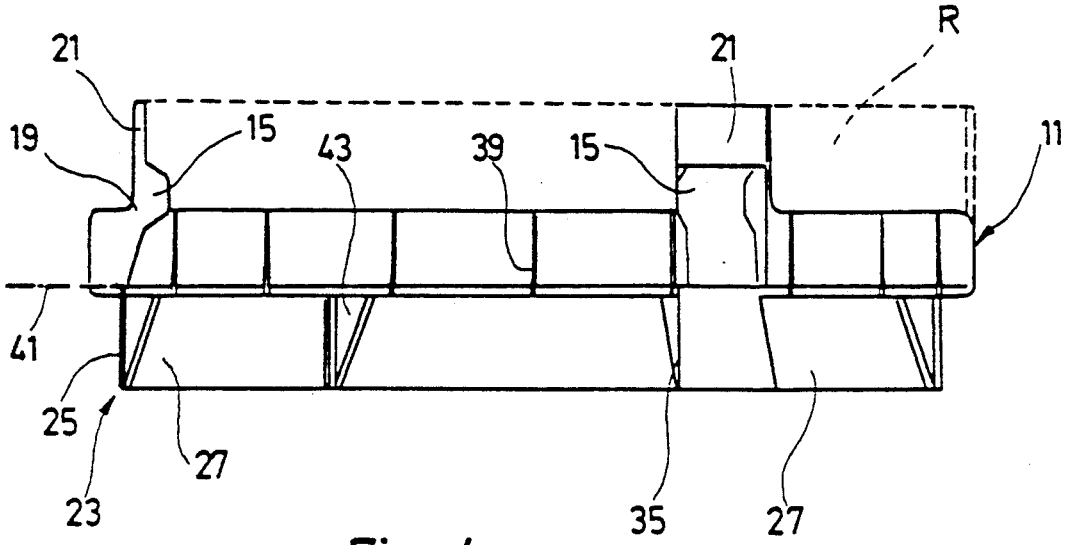
FIG. 4: a side view of a ring in cross section along the line IV—IV in FIG. 3.

FIG. 4 shows a section through the ring 11 on the line IV—IV in FIG. 3. Identical parts bear the identical reference numbers. In this drawing, the upper ring section of the ring 11 can be clearly seen, and this fits in the annular groove formed by the annular bead 9. The drawing shows one projection 15 in cross section and another in perspective. It can be clearly seen that the projection 15 that meshes with the thread 33 on the container 31 extends from the bridge piece 19 that continues upwards to become the standoff strip 21. The lower ring section 23 of the ring 11 is connected to the upper ring section of the ring through the thin tear bars 39 that are arranged at intervals from each other, so that the nominal break line 41 is formed on which the lower ring section 23 can be torn away from the upper ring section. FIG. 4 once again shows clearly the wall segments 27*a* and 27*b* that extend from the essentially vertical side wall 25 of the lower ring section 23, and which serve as barbs. In the area of the projection 15 there are shown the cuts 35, i.e., the wall section of the lower ring section 23 that forms the barbs 27 and is not continuous. Within the area of the cuts 35 the lower ring section 23 is connected to the upper ring section of the ring 11 through a web, the width of which is approximately equal to the width of a bridge piece 19. A section 43 that is V-shaped in plan view as in FIG. 3 is adjacent to the segment 27*b* of the wall area of the lower ring section 23 that serves as a barb 27, and this serves as a vertical cut. Within this area the thickness of the vertical side wall 25 of the lower ring section 23 is thinner than in the remaining areas. When the screw cap 1 is first opened, the lower ring section 23 can be snapped off at this point.

A dashed line in FIG. 4 shows that the projection 15 and the standoff strip 21 can be formed as part of an annular wall R that extends from the upper ring section of the ring 11. This renders the ring particularly stable. The height of the annular wall R is preferably greater than the height of the projection 15 as measured in a vertical direction. The area of the annular wall R that extends beyond the projection 15 serves, in the same way as the annular wall between the individual projections, as a spacer. Thus, the function of this area corresponds to the function of the standoff strip 21.

Figure 5:
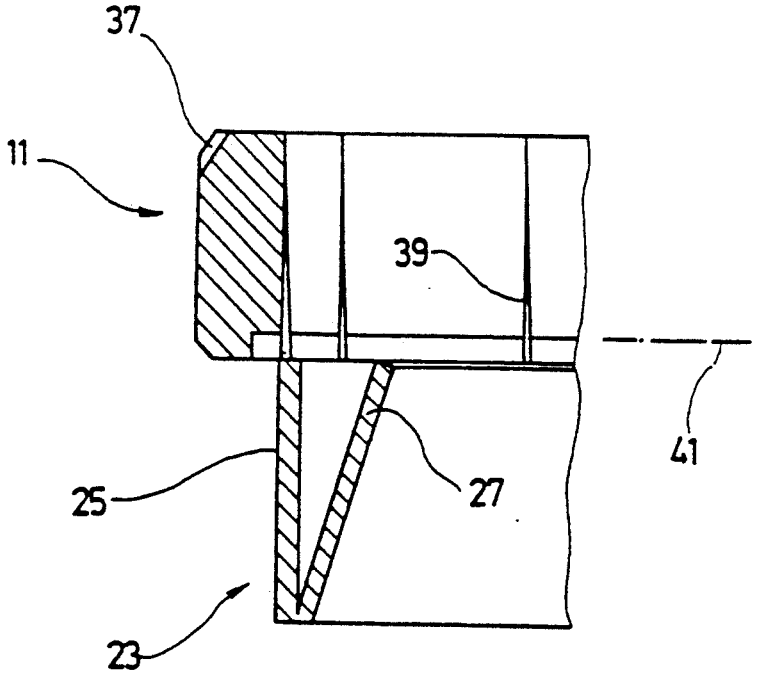
FIG. 5: an enlarged partial view of a ring in cross section on the line V—V in FIG. 3.

FIG. 5 shows an enlarged cross section on the line V—V in FIG. 3, through the ring 11. Identical parts bear identical reference numbers.

This drawing clearly shows the depression 37 that is part of a so-called undulating pattern of the ring 11 and which ensures an improved form-fit between the screw cap 1 and the ring 11. The upper ring section of the ring 11 that lies in the annular groove formed by the annular bead 9 is connected to the lower ring section 23 through the tear bars 39, these tear bars extending on the inner surface of the upper ring section of the ring 11 and opening out on the upper side of the vertical side wall 25 of the lower ring section 23. It is preferred that the ring 11 be produced by injection molding, so that the tear bars 39 are formed on the upper and the lower ring section 23. The segments 27*a*, 27*b* of the lower ring section 23 which serve as the barbs 27 extend from the lower limiting edge of the vertical side wall 25 of the lower ring section 23.

The break line 41 is formed by the tear bars 39 that are arranged at intervals from each other.

FIG. 6 shows an enlarged cross section on the line VI—VI in FIG. 3, this being taken through the projection 15 of the ring 11. Identical parts bear identical reference numbers.

It can be seen that the projection 15 extends from the bridge piece 19 that extends in the upper inner area of the upper ring section of the ring 11, which lies in the annular groove formed by the annular bead 9. The bridge piece 19 continues as a standoff strip 21 that is oriented upwards. FIG. 6 shows that the lower ring section 23 is connected in the area of the bridge piece 19 through a web 45, the width of which corresponds to the width of a bridge piece 19. In the area of the web 45, the vertical side wall 25 of the lower ring section 23 is thinner than it is in the remaining areas.

FIG. 7 shows an enlarged cross section through the ring 11 on the line VII—VII in FIG. 3. The section runs through a V-shaped section 43 that can also be seen in FIG. 4. Identical parts here bear identical reference numbers.

Within the area of the V-shaped section 43 the vertical side wall 25 of the lower ring section 23 is even thinner than in the area of the web 45. The wall area that serves as the barbs 27 at the lower edge of the lower ring section 23 is extremely thin here.

The nominal break line 41 that is formed by the tear bars 39 continues in the area of the V-shaped section 43.

The function of the screw cap 1 is described in greater detail below. If the cap element 3 of the screw cap 1 is produced from material that can be deep drawn, as is shown in FIGS. 1 to 2, the upper portion of the ring 11 is installed in the annular groove 9. Then, the lowest edge of the cap element 3 is beaded so that the beaded edge 13 results and the ring 11 is attached firmly to the cap 3. It is also possible to press the ring 11 into the previously beaded groove and let it snap into position. In order to prevent any relative movement between the cap element 3 and the ring 11, cylindrical grinding is carried out with depressions 37 that provide for increased friction. It is also possible, when beading the beaded edge 13, to form punctures at individual points, so that holes or depressions result in the beaded edge 13. Because of the burr of the holes or the recesses, there is a firmer shape fit with the underside of the ring 11, so that it then becomes impossible for the ring 11 to turn within the cap element 3.

The cap element 3 can also be of rigid plastic. The connection between the cap element 3 and the ring can thus be produced by snapping in or impressing the two parts into each other. The inner side of the cap element 3 and the outer side of the ring can be knurled so as to prevent any mutual rotation, a relative movement between two parts.

The screw cap 1 produced in this manner can be screwed on to a filled container, a bottle, a jar or the like. Because the ring 11 is of an elastic material, preferably plastic, the wall areas of the lower ring section 23, which serve as the barbs 27, can be tilted towards the vertical side wall 25 without the lower ring section 23 being over-extended. Once the screw cap 1 has been installed or screwed into position, the barbs 27 snap under suitable projections, for example threads 33, on the container 31, and spring out in the direction of the outer wall of the container 31 or in the direction on the midline axis 17 of the screw cap 1, respectively.

When the container 31 is being closed, the projections 15 of the ring 11 engage in the thread 33 of the container 31.

When the containers 31 is first opened, the projections 15 also serve as "threads" for the screw cap 1.

When the cap element 3 is rotated, the screw cap 1 and the annular section are lifted from the container 31. When this happens, the barbs 27 hook on the suitable threads 33 or projections on the container 31. Because of the barbs, the lower ring section 23 is over-extended, so that this tears away from the upper ring section along the nominal break line 41 and is snapped off in the area of the V-shaped sections 43. The resulting three segments of the lower ring section 23 are forced outwards by the barbs 27. This provides a clear indication for the user that the container has been opened for the first time.

In order to apply the force that is required during this first opening, the projections 15 must engage firmly with the thread 33 of the container 31. The standoff strip 21 of the bridge pieces 19 then serves to center the ring 11 on the neck of the container 31. They lie in the intervening space between the vertical side wall section 5 of the cap 3 and the outer surface of the container 31.

According to FIG. 3, it is possible to associate a projection 15 with each standoff strip 21. In the embodiment shown, by way of example, there are three projections 15 and standoff strips 21.

However, it is also possible to provide a standoff strip 21 opposite each projection 15 in order that the projection 15 is held on the thread 33 of the container 31. The standoff strips 21 can, in their turn, be provided with a projection 15.

Fundamentally, the projections 15 could extend directly from the ring 11. However, because of the fact that the projections 15 are connected to the ring 11 through a bridge piece 19 there is a certain springing effect so that any tolerances in the mouth or the diameter of the container 31 can be compensated for.

It can be seen that screw 1 can be easily produced, without the requirement for any rolling process required in order to generate a thread. This precludes any damage being done to the mouth area of the container that is to be closed. In a simple and economical manner it is possible to create a screw cap with a "thread" that will not only work with normal continuous threads on a container, but will also work within the individual threaded projections of so-called twist-off containers.

Figure 8:
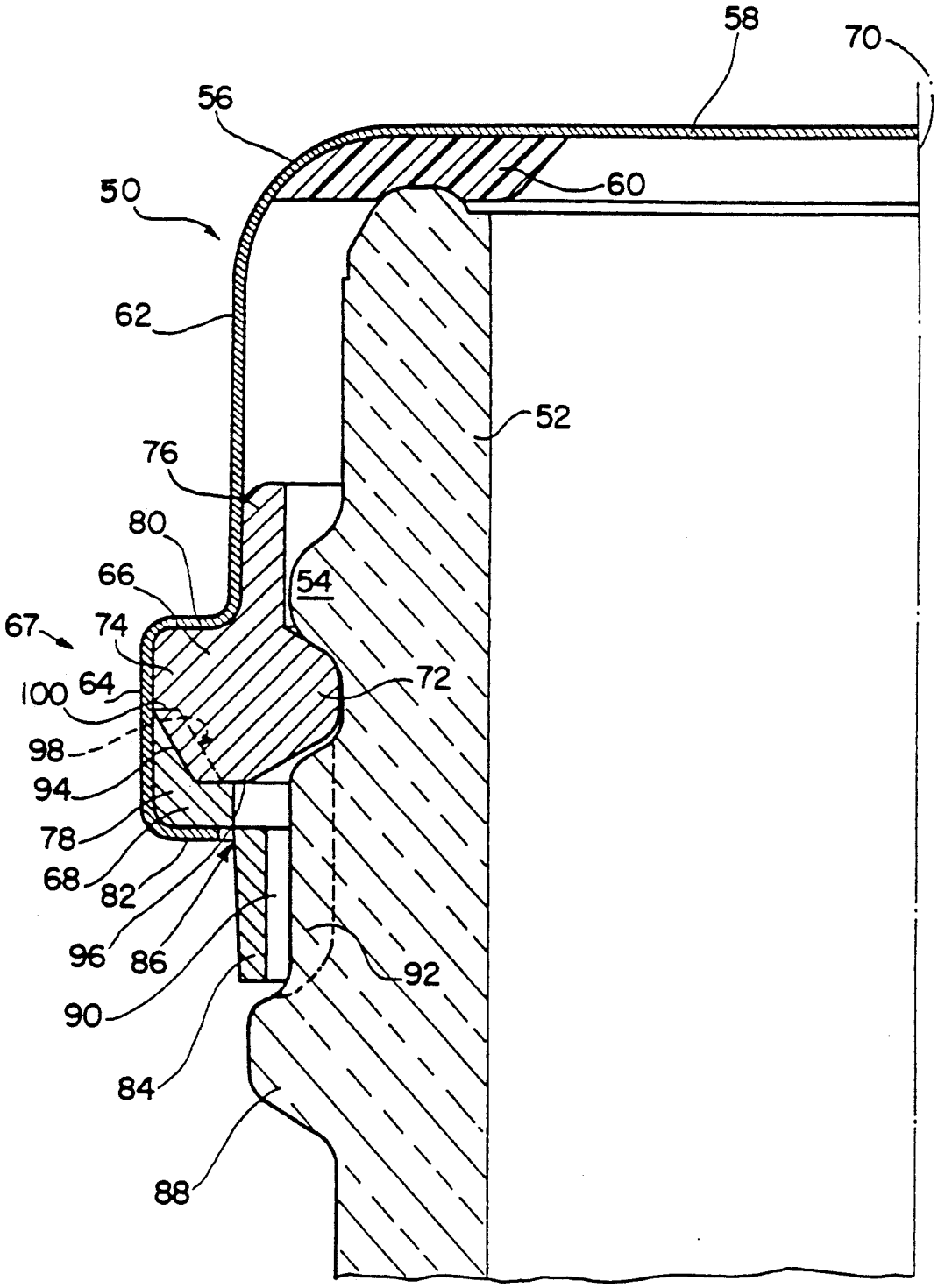
FIG. 8: a partial view through an undamaged screw cap that is screwed onto a container.

FIG. 8 is a partial section through a screw cap 50 that is installed on a container 52. The figure shows only the upper mouth area of this container 52 that incorporates a thread 54 on its outermost side. The thread can consist of a continuous thread on the outside of the container or of individual and separate thread sections. Thus, it is not essential that the threaded sections incorporate a pitch. It is sufficient if these, like a bayonet coupling, extend horizontally and end at a stop. Such threaded sections are found, for example, in jam jars, as well as in bottles that are used for juices or milk.

The screw cap 50 has a cap element that is of resistive plastic or deep drawn material, for example, sheet metal, and in particular aluminum. The bottom 58 of the cap element 56 is essentially flat and on the inner side that is proximate to the container 52 incorporates a seal 60, which can be so configured as to be annular.

A side wall 62 of the cap element 56 merges into an annular bead 64 at its lower end that is remote from the bottom 58, and this bead 64 defines on its inner side-an annular groove. The outside diameter of the annular bead 64 is somewhat greater than that of the side wall 62.

The annular bead 64 encloses a ring 67 that incorporates an upper ring element 66 and a lower ring element 68. On a side that is proximate to the midline axis 70 of the ring 67, the upper ring element 66 incorporates at least one projection 72 that comes to rest beneath the thread 54 when the screw cap 50 is screwed onto the container 52. The projection 72 forms the "thread" of the screw cap 50, in which the cap element has no thread of any sort in its side wall 62.

There is at least one projection 72 provided on the inner side of the ring 67; the embodiment shown here incorporates three projections 72 that are spaced equidistantly on the periphery of the screw cap 50.

It can be seen from this drawing that the upper ring element 66 incorporates an annular bead 74 that lies in the annular groove of the cap element 56 that is formed by the annular bead 64. The annular bead 64 does not have to continuous; it is also possible to incorporate several bead segments on the outer side of the upper ring element 66.

The upper ring element 66 continues in the direction of the bottom 58 of the cap element 56 to become a spacer that is configured in this particular embodiment as a continuous standoff ring 76. The serves to center the screw cap 50 on the containers 52. In addition, it prevents direct contact of the cap element 56 with the container 52 and thus reduces the friction generated when the screw cap 50 is screwed on or unscrewed.

The lower ring element 68 also has an annular bead 78 that is arranged in the annular groove that is enclosed by the annular bead 64 of the cap element 56.

The height of the annular bead 64 or of the annular groove is so matched to the height of the annular bead of the upper ring element 66 and of the lower ring element 68 that these are firmly enclosed. When this is done, the annular bead 74 of the upper ring element 66 lies firmly on an upper limiting wall 80 of the annular groove and the lower limiting wall of the annular bead of the lower ring element 68 lies on a lower defining wall 82 of the annular groove. The lower limiting wall 82 can be formed by beading the cap element 56. However, it is also possible to perform the annular groove and allow the ring 67 to snap into this annular groove.

A safety ring 87 is connected with the lower ring element 68 there being a nominal break line 86 between these two parts. This can consist of a wall of thin material, but also, as in the case of the present embodiment, of individual retaining webs.

A safety bead 88 is formed on the outer side of the container 52, beneath the safety ring 84, viewed from the midline axis 70, and this is oriented outwards and protects the safety ring 84 from unintentional damage and manipulation. In addition, the safety ring 84 is protected in that the outside diameter of the annular bead 64 is significantly greater that of the safety ring 84. This, too, helps avoid any possible damage.

A plurality of bridge pieces 90 extends from the inner side of the safety ring 84 that is proximate to the midline axis 70, and these press elastically against the outer side of the container 52. In the area of the safety ring 84 or of these bridge pieces 90 the container 52 is provided on its outer side with at least one and preferably a plurality of detent depressions 92, into which the bridge pieces 90 can fit.

A first annular wall 94 extends outwards at an angle from an underside 96 of the upper ring element 66; this first annular wall 94 is fitted with form-fit means. In a corresponding manner, a second annular wall 98 extends inwards at an angle from upper side 100 of the lower ring element 68 and this, too, is fitted with form-fit means. A reversed configuration of the ring is possible.

The shape-fit means that are provided on the annular walls 94 and 98 fit into each other so that any relative movement or any rotation of the upper ring element 66 relative to the lower ring element 68 is prevented.

FIG. 9 shows a partially cross sectioned screw cap 50 without a container that is to be closed. In FIGS. 8 and 9, similar parts bear the same reference numbers. In this drawing, the bridge pieces 90 that extend from the safety ring 84 in the direction of the midline axis 70 can be clearly seen. In this embodiment, the width of the bridge pieces 90 corresponds at their origin to the height of the safety ring 84. It is clear that the width of the bridge pieces 90 grows smaller at the end that is opposite to their origin. This means that the upper edges of the bridge pieces 90 all lie in the same plane. The upper edge of the safety ring 84 also lies in this plane.

FIG. 10 is a plan view of the upper ring element 66 of the ring. Parts that match the parts shown in FIGS. 8 and 9 bear the same reference numbers.

It can be seen that the embodiment shown here incorporates three projections 72 that extend from the inner side of the upper ring element 66 in the direction of the midline axis 70 and that these form the "thread" of the screw cap 50.

The inside surface of the upper ring element 66 continues in the standoff ring 76. The outside diameter of this ring 76 is smaller than the diameter of the annular bead 74 of the upper ring element 66. The upper side of the annular bead 74 is smooth in this embodiment. However, it can also be provided with projections or with depressions in order to improve the friction connection with the annular bead 64 of the cap element 56 of the screw cap 50.

Figure 11:
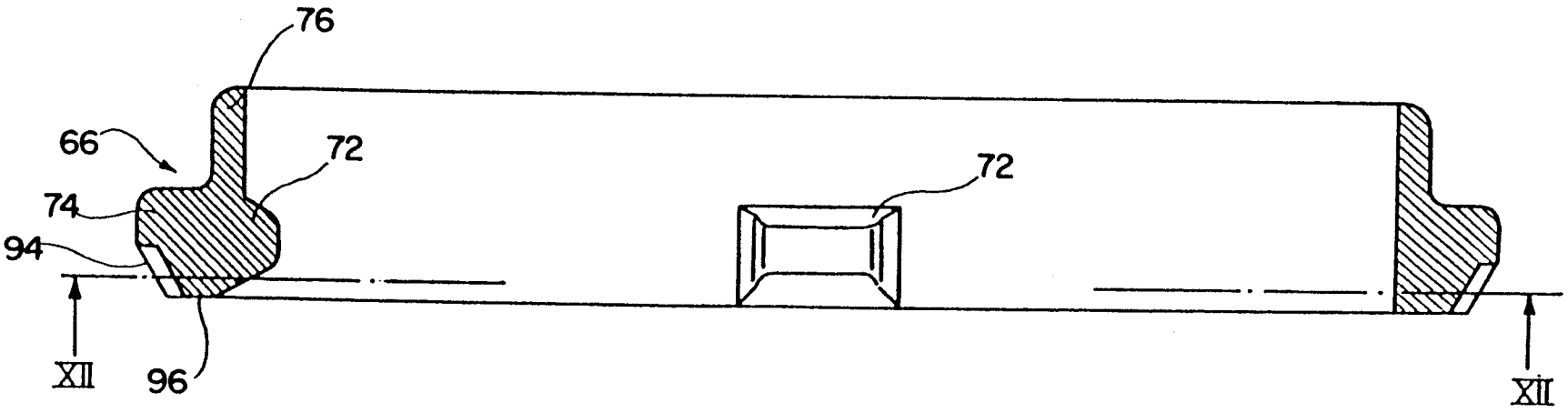
FIG. 11: a cross section on the line XI—XI in FIG. 10 through the midline axis of the upper ring element.

FIG. 11 shows a cross section through the midline axis 70 of the upper ring element 66. Parts which coincide with those in the previous embodiments bear the same reference numbers.

The drawing shows that the upper ring element 66 is configured to be relatively thick in the area of the annular bead 74, which means that the forces that are applied to the projections 72 be properly absorbed transferred into the annular bead 64 of the cap element 56. The shape of the projections 72 is clear and these can be designed fundamentally in any shape although they must be adapted to the thread of the container.

The projections 72 are of essentially rectangular shape and their cross section is trapezoidal for all partial purposes, their base area corresponding with the inside surface of the upper ring element 66. In this embodiment, the side limiting surfaces of the projections are inclined at an angle of 30° to the horizontal. The height of the projections measured in a radial direction is approximately half as great as the width that is measured parallel to the midline axis. The dimension measured in the peripheral direction is approximately twice as great as the width of the projections measured in the direction of the midline axis 70.

The first annular wall 94 that extends from the underside 96 of the upper ring element 66 is here inclined at an angle of approximately 30° relative to the perpendicular. It can be seen from the drawings that there are depressions in the first annular wall 94 which are intended to provide a form fit with the lower ring element 68. The thickness of the standoff ring 76 is matched to the free space between the cap element 56 and the thread of the container 52. The height of the standoff ring 76 depends on the height of the threaded area on the outside of the container 52.

A cross section of the line XII—XII shown in FIG. 11 and perpendicular to the midline axis 70 of the upper ring element 66 is shown more precisely in FIG. 12. Here, parts that correspond with those in the preceding drawings bear the same reference numbers. FIG. 12 shows that there is a plurality of projections 102 incorporated as form-fit means on the first annular wall 94; the cross section of these is so configured as to be saw-toothed, so that stop surfaces 104 that are oriented in a clockwise direction, which is to say in the direction in which the cap is screwed on, result. It is also possible that the cross section of the projections 102 can be, for example, triangular. In any case, the transfer of forces when the cap is screwed on or removed is significant. In this embodiment, the projections 102 are provided only in the area of the projection 72. However, they can be provided on the whole of the first annular wall 94 of the upper ring element 66.

FIG. 13 shows the underside of a lower ring element 68. Here too, parts that match those shown in the previous drawings bear the same reference numbers.

It can be seen that the lower limiting surface of the annular bead 78, which is adjacent to the lower defining wall 82 of the annular groove, is configured so as to be flat. However, it is also possible to provide depressions and/or projections here that ensure a form fit between the cap element 56 and the lower ring element 68.

It can be seen that the nominal break line 86 in this embodiment is formed by a plurality of retaining webs 106, these being arranged at intervals from each other. The number of these retaining webs will depend on the material from which the lower ring element 68 is made, this preferably being of plastic. The retaining webs are provided here on the outer side of the safety ring 84. They are of essentially triangular cross section, the base surface of this triangle corresponding with the outer side of the safety ring 84. The upper sides of the retaining webs 106 merge into the lower side of the lower ring element 68, so as to form a connection between the safety ring 84 and the lower ring element 68.

At least one bridge piece, which subtends an angle of 5° to 85°, preferably from 20° to 70°, and in particular from 35° to 55°, with a line that intersects the origin of the bridge piece 90 and the midline axis 70 extends from the inner side of the safety ring 84. The length of the bridge pieces 90 is so selected that they lie on the outer side of the container 52 that is to be closed. The material from which the safety ring 84 or the lower ring element 68 is produced is so selected that the bridge pieces 90 lie under tension on the outer side of the container, which is to say they serve as spring elements. By this means, tolerance differentials, such as variations in the diameter of the container or of the safety ring 84, can be balanced out. In the embodiment shown there is a plurality of bridge pieces 90, these being in an area that corresponds to an arc with an opening angle of 210°. This angular area can lie between 360° and 180°, and preferably between 250° and 200°.

In the area in which the bridge pieces 90 are located, the wall thickness of the safety ring 84 is thinner than at the point where no bridge pieces 90 protrude. Approximately in the center of the area without bridge pieces 90 there is a weakening of the material, here preferably a recess 108, which runs parallel to the midline axis of the cap. The safety ring 84 is thus not configured so as to be continuous.

The areas adjacent to the recess 108 are held by the retaining webs 106. In the area of this recess there are no bridge pieces 90, so that here the safety ring 84 cannot be pushed outwards by the spring action of the bridge pieces 90, by which means any damage to the safety ring 84 and thus the fact that the container 52 had been opened would be indicated.

In the area in which there are bridge pieces 90, the thickness of the safety ring 84 is approximately 30% of the thickness of the lower ring element 68. The thickness of the safety ring 84 is so selected that when the container 52 is opened it is possible for the retaining webs 106 to snap off. This function of the safety ring 84 is described in greater detail below.

Figure 14:
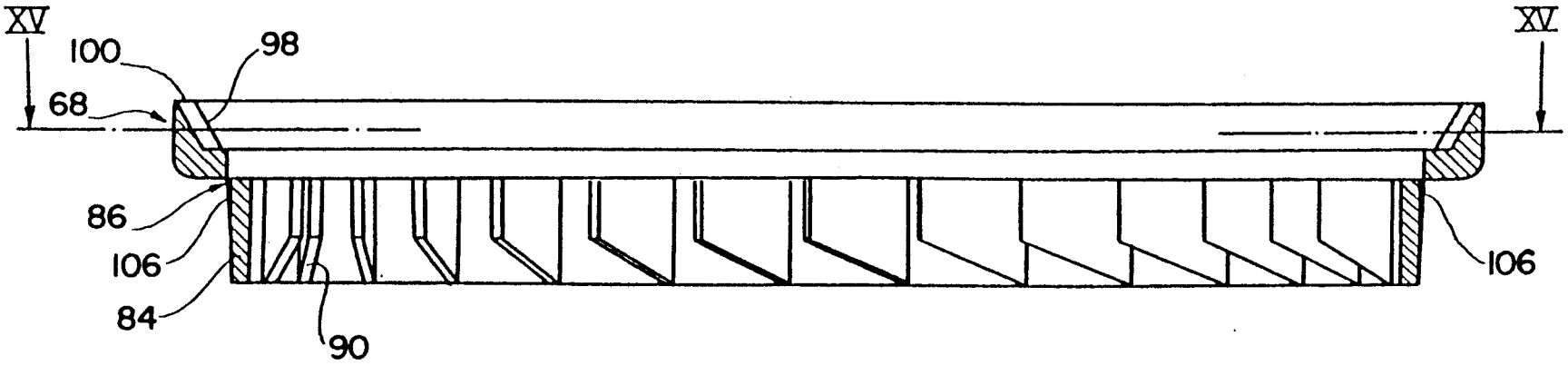
FIG. 14: a cross section of the lower ring element passing through the midline axis.

FIG. 14 shows, a cross section through the midline axis 70 of the screw cap 50, through the lower ring element 68. Those parts that correspond to the parts used in the previous drawings bear the same reference numbers.

The second annular wall 98 extends from the upper side 100 of the lower ring element 68 and is inclined at an angle of approximately 30° to the perpendicular. The angle matches that of the annular wall of the upper ring element 66. There are also form fit elements incorporated on the annular wall of the lower ring element 68.

The safety ring 84, on the inside of which the bridge pieces 90 extend, is connected with the lower ring element 68 through the nominal break line 86. This nominal break line 86 is formed by the plurality of retaining webs 106 on the outer side of the safety ring 84, these being of essentially triangular cross section. However, it is also possible to provide retaining webs 106 of this sort on the inside of the lower ring element 68.

This drawing makes it particularly clear that the upper edges of the retaining webs 106 lie in one plane, the upper edge of the safety ring 84 also lying in this plane. It can also be seen that the width of the bridge pieces 90 decreases from their origin to their opposite end.

Figure 15:
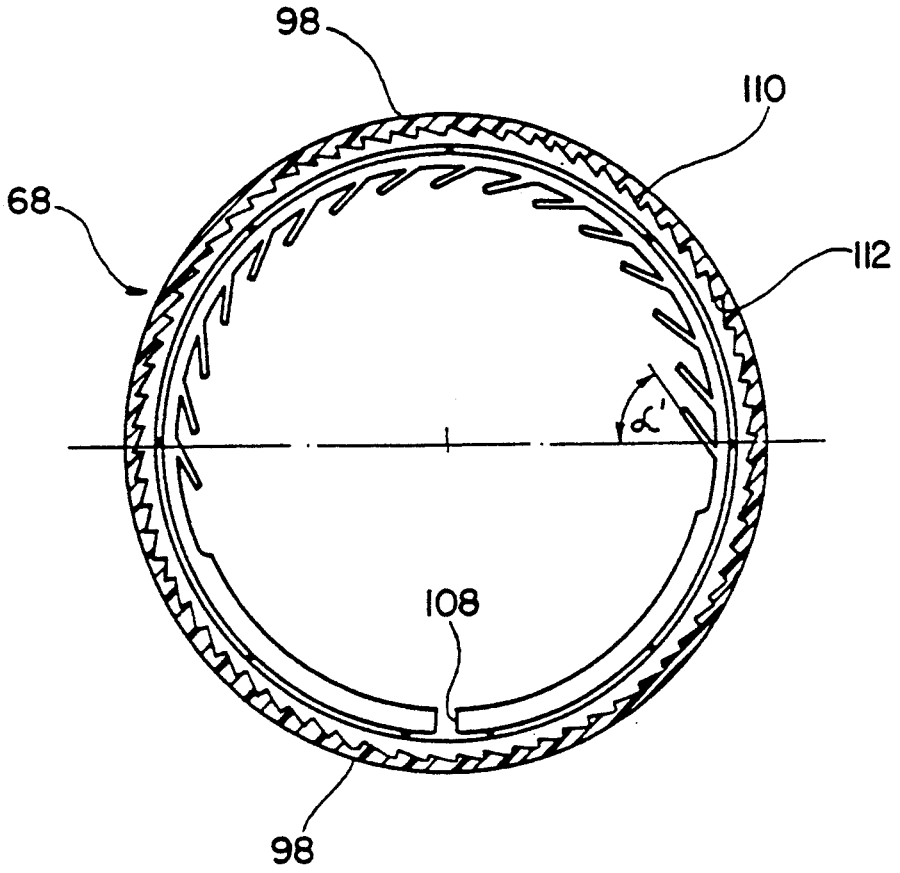
FIG. 15: a cross section along the line XV—XV in FIG. 14, through the lower ring element.

Finally, FIG. 15 is a cross section through the lower ring element 68 along the line XV—XV shown in FIG. 14. Once again, identical parts bear identical reference numbers.

It can be seen that projections 110 that serve as form-fit elements are incorporated on the upper side of the lower ring element 68 or on the second annular wall 98, these projections 110 incorporating stop surfaces 112 that are oriented counter-clockwise, or opposite the direction in which the screw cap 150 is screwed on.

The projections 110 can also be of triangular cross section. It also conceivable that these projections 110 like those on the upper ring element 66 can be of essentially rectangular cross section. It is, important that a form-fit be formed between the two ring elements 66 and 68.

In this embodiment, the projections 110 are distributed around the whole of the perimeter of the lower ring element 68 so that a form-fit is always ensured, regardless of how the upper ring element 66 and the lower ring element 68 are assembled. It is preferred that the projections 110 be offset so as to ensure that the ring elements 66 lock together securely.

When the two ring elements 66 and 68 are assembled and installed in the, annular groove in the cap element 56 that is formed by the annular bead 64, the projections 102 and 110 work in conjunction with each other. Because of the orientation of the stop surfaces 104 and 112 there is a particularly good locking between the ring elements if the lower ring element 68 is rotated clockwise with the help of the screw cap 50 t which is to say, in the direction in which a screw cap 50 t is installed. In this case, by so doing, a particularly good force is transferred to the upper ring element 66. In this way it is ensured that when a container 52 is closed with the help of a screw cap 50 tt, the projections 72 mesh with the threaded sections 54, thereby ensuring that the container 52 is securely closed. From what has been said above it is clear that the conical configuration of the annular walls ensures optimal centering of the two ring elements. However, it is also possible to incorporate the form-fit elements on one flat underside of the upper ring element and on a flat upper side of the lower ring element. Form-fit elements can then be dispensed with if the friction between the ring elements is sufficient to transfer the force that is required to open and close the container.

It is preferred that the form-fit elements be so configured that there is a secure hooking action between the two ring elements.

In order to ensure the transfer of force from the cap element 56 to the ring that consists of the ring elements 66 and 68, it is preferred that a plurality of holes be punched into the lower defining wall 82 of the annular groove. An optimal form-fit between the cap element 56 and the ring is ensured as a result of the raised edges of the holes that project in the annular groove, the edges of these holes then pressing into the under side of the lower ring element 68. The configuration of the form fit between the cap and the ring can, however, be selected as desired.

The function of the screw cap 50 tt is described in greater detail below. As in conventional caps, the screw cap 50 is screwed onto the container 52 that is to be closed. When this is done, the projections 72 of the upper ring element 66 of the ring serve as a "thread" for the screw cap 50 tt; that is to say, the cap element is configured so as to be flat on its side walls 62. This screw cap 50 t incorporates no threads of any kind.

When the screw cap 50 tt is screwed down onto the container 52, the bridge pieces of the safety ring 84 lie on the inner side of the safety ring 84 because of their spring action, and thus slide along the outer surface of the container 52. The spring, action of the bridge pieces is so selected that the retaining webs 106 of the nominal break line 86 are not burst off. If the screw cap 50 is removed from the container 52 the ends of the bridge pieces that are remote from the safety ring 84 hook into the detent depressions 92 that are incorporated in the outer side of the container. These also incorporate a corresponding stop for the front ends of the bridges pieces 90. In the figures, the bridge pieces 90 are at the same distance from each other. However, it is also possible to arrange them at varying intervals on the safety ring 84. This improves the manner in which they lock with the container when the cap is screwed on.

When the screw cap 50 is screwed off, the bridge pieces 90 hook into the detent depressions of the container 52 such that further rotation of the safety ring 84 is not possible. There is a radial relative movement below the lower ring element 68 of the ring and the safety ring, whereby the retaining webs 106 of the nominal break line 86 are sheared off. When this happens, not all of the retaining webs 106 are burst, so that the safety ring 84 remains hanging on the lower ring element 68 and is lifted from the container 52 with the screw cap 54.

Once the front ends of the bridge pieces 90 have latched into the detent depression 92, on further rotation of the screw cap 50 t the bridge pieces 90 are so tilted that the diameter of the safety ring 84 is increased. This means that the retaining webs 106 of the nominal break line 86 are not only acted on by a force in the peripheral direction, but also radially outwards. The nominal break line 86 is burst particularly easily, which is to say, with very little force, because of this double stressing of the retaining webs 106. This also provides a particularly good indication of an attempted opening of the container.

Because of the construction of the safety ring 84 described herein, even after a very short rotation of the screw cap 50, the bursting of the nominal break line 86 is ensured. Even without the screw cap 50 tt being raised by the thread when the container is opened, the safety ring 84 will burst. This is particularly important in the case of the so-called twist-off caps, because in such an application the threaded sections 54 have no pitch. That is to say, even after a very short rotation of the screw cap, the safety ring 84 is burst. Even without the screw cap 50 t raised from the container 52, there will be an indication that an attempt has been made to open the container. This ensures that a vacuum within the interior of the container 52 cannot be destroyed without this fact being recognized by the user.

From what has been said above, it is plain that the spring action of the bridge pieces 90 is essential for the functioning of the safety ring 84. Because of the fact that the safety ring 84 is assembled from an upper ring element 66 and a lower ring element 68 a particularly elastic sprung element, for example, of plastic, can be selected for the lower ring element 68. The upper ring element 66 must absorb the forces that act in conjunction with the threaded sections 54 and for this reason can be produced from a somewhat harder plastic.

It can also be seen that the connection between the two ring elements can be configured so as to be permanent; for example, welding or adhesion of the two parts can be selected.

If simple production of the ring elements is not important, for example, in a small series, both elements can be produced together by an injection-moulding process. When this is done, the safety ring can be molded at the same time.

Fundamentally, the screw cap 50 tt according to the present invention can be used for any container. It is also possible to provide the ring of the screw cap with a safety ring which is torn away from the remaining ring when the screw cap is opened for the first time, or which is at least burst off so that the integrity of the container is immediately recognizable. FIGS. 16 to 20 show a screw cap with a safety ring by way of an example.

Figure 16:
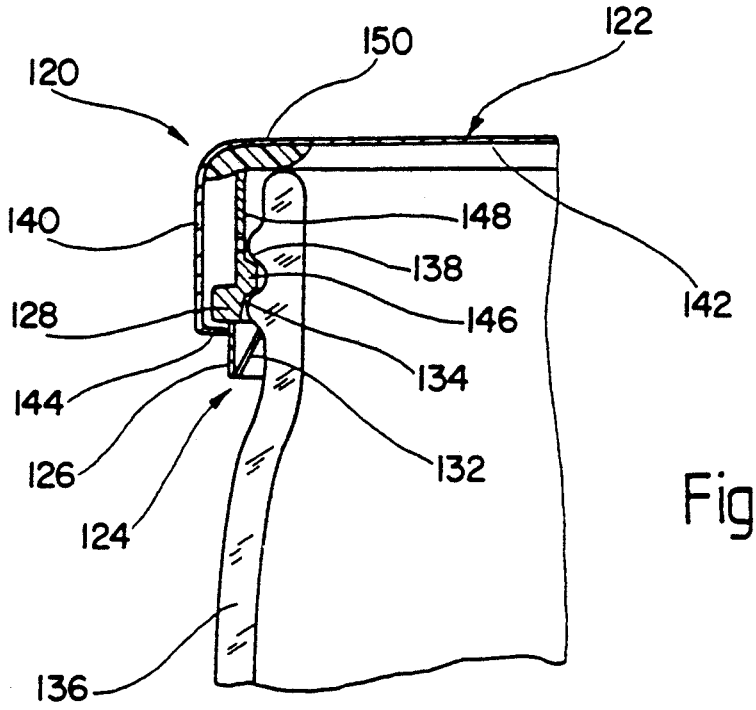
FIG. 16: a partial section through a screw cap installed on the container.

The embodiment of the screw cap 120 that is shown in FIG. 16 incorporates a metal cap 122 as well as a ring 124 which is here configured as a safety ring. That is to say, on the under side of the ring 124 there is a lower ring section 126, which is connected to an upper ring section 128 of the safety ring through a nominal break line 130. A spring barb 132, configured as a truncated conical casing extends from the lower ring section 126 and this works in conjunction with a projection 134 on the outer side of a container 136 on which the screw cap 120 is to be installed. Here, the projection 134 is part of a thread 138 that is incorporated in the upper opening area of the container.

The cap 122 is essentially bowl-shaped. Its side wall 140 incorporates on its edge that is opposite a bottom 142 a projection 144 that extends inwards, which secures the ring 124.

Whereas the cap 122 has no thread of any kind on its side wall, the ring 124 has a projection 146 on its inner side and this engages in the thread 138 on the outside of the container 136. The projection 146 is here provided on the upper ring section 128 of the ring. A detent projection 148 extends from the ring in the area of the projection 146 and this extends upwards in the direction of the bottom 142 of the cap, where it works in conjunction with a blocking element 150 that is configured as a sealing ring.

Figure 17:
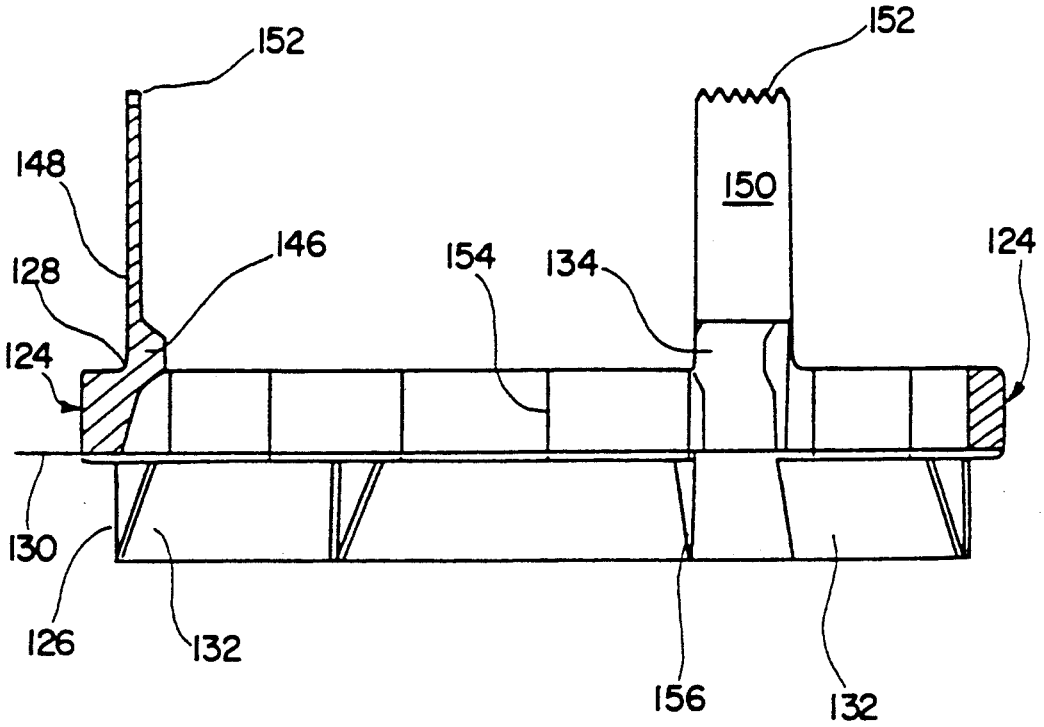
FIG. 17: a cross section through a ring of a screw cap as in FIG. 16.

In FIG. 17, the ring 124 has been removed from the metal cap 122 the screw cap 120 tt. Identical parts bear identical reference numbers.

The ring 124 is provided with three detent projections 148 that extend from the base body of the upper ring section 128 and these are arranged in the area of the projection 146 that serves as the "thread". The number of detent projections 148 and their arrangement can be selected as desired. On the upper side, the detent projections 148 are provided with teeth 152 that engage in a sealing ring that serves as the blocking element 150. If there is sufficient contact pressure of the detent projection 148 against the blocking element 150, it is possible to dispense with the teeth 152. On the other hand, it is also possible to eliminate the teeth 152 on the detent projection 148 and provide the blocking element 150 in the cap with teeth for this purpose. Finally, it is also possible to provide both the detent projection and the blocking element with suitable teeth.

It can be seen from FIG. 17 that the upper ring section 128 is connected with the lower ring section 126 through the nominal break line 130 that is formed from a plurality of tear tags 154 that are provided between the upper 128 and the lower 126 ring sections.

According to FIG. 17 a plurality of barbs 132, formed as truncated conical casings, extend from the lower ring section 126. By way of example, in the area of the projection 146 or of the detent projection 148 the lower ring section 126 can be provided with a tear line or with a vertical cut 156 on which the lower ring section 126 tears when the screw cap is first opened, so that the first opening of the container will be clearly indicated.

FIG. 18 shows a further embodiment of a ring 170 in which identical parts bear identical reference numbers.

This embodiment is characterized in that a continuous annular casing that serves as a detent projection 172 extends from the upper ring section 174 of the ring 170, the upper edge of this working in conjunction with the blocking element 150 that is arranged in the transitional area between the bottom 142 and the side wall 140.

In a screw cap that incorporates a ring 170 of this kind, it is almost impossible for the cap and the container to become stuck or glued together, even if the contents contain sugar.

The upper edge of the detent projection 172 which engages with the blocking element incorporated in the cap, can be configured so as to be flat. If the materials are properly matched, in particular when the contact pressure has been selected to be great enough, sufficient frictional forces can build up that make it impossible to rotate the cap relative to the ring. However, as is shown in FIG. 18, it is also possible to provide teeth 176 on the upper side of the detent projection, at least in the area of the projections 178 which serve as a "thread", these then engaging in the blocking element. The teeth can be provided either only on the detent projection, only on the blocking element, or on both parts.

Figure 20:
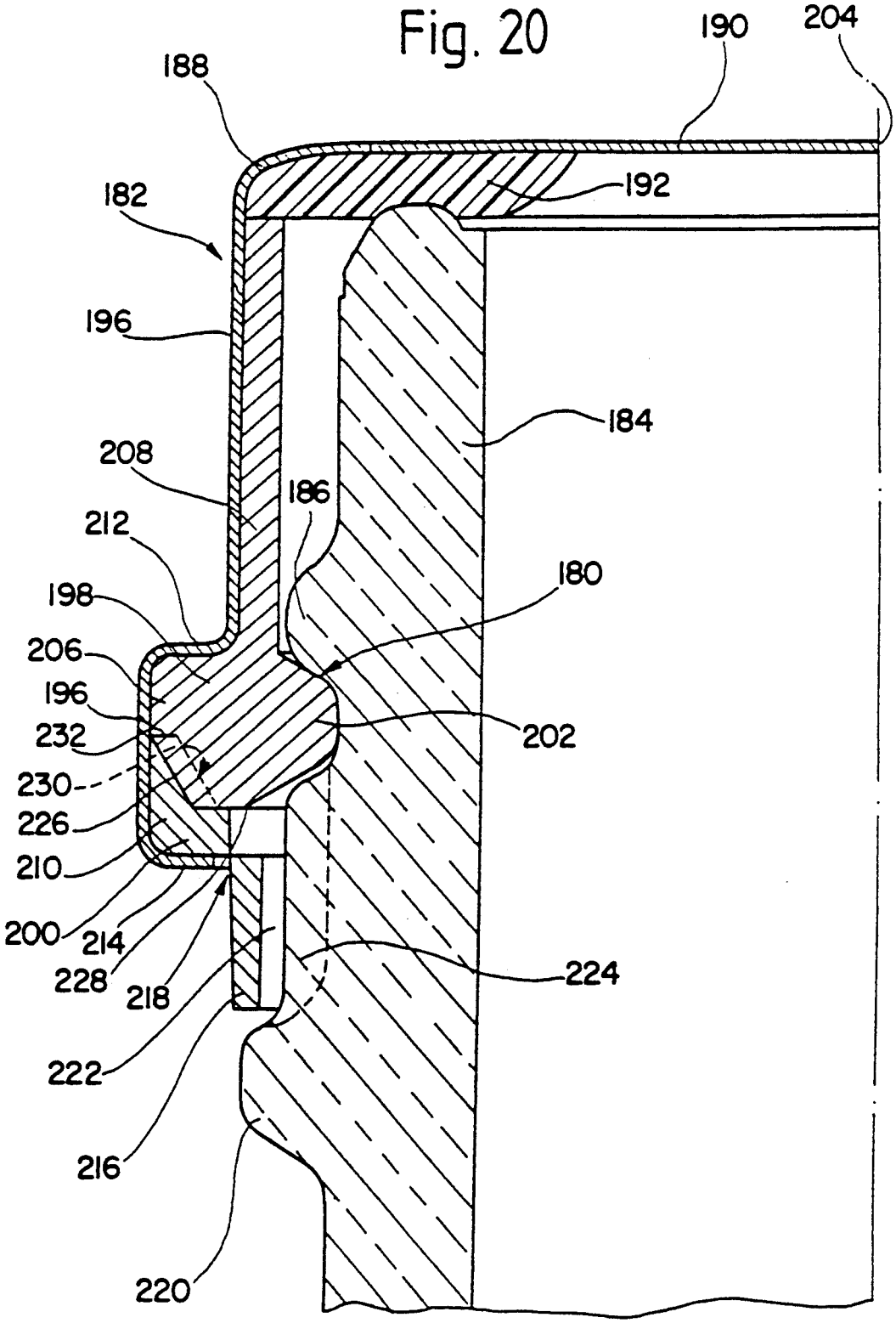
FIG. 20: a cross section through the screw cap as in FIG. 19.

FIGS. 19 and 20 show a further embodiment of a cap which is provided with a two part ring 180.

FIG. 19 is a partial cross section through a screw cap 182, that is installed on a container 184. The figures show only the upper mouth or opening area of this container 184, that is provided with a thread on its outer side. The thread can be in the form of a continuous helical thread on the outside of the container or else can consist of individual thread extensions 186. It is not essential that the thread extensions incorporate a pitch. It is sufficient if these, like a bayonet fastening, extend horizontally and end in a stop. Thread projections of this kind are used, for example, in jam jars, as well as in bottles that are used for juices or milk.

The screw cap 182 incorporates a cap 188 that is of resistive plastic or of a deep drawn material, for example, sheet steel, preferably of aluminum. The bottom 190 of the cap 188 is essentially flat and incorporates on its inner side that is proximate to the container 184 a blocking element 192 that is configured as a seal, and which in this instance is annular, although this can also be in the form of a disk.

The side wall 194 of the cap merges at its lower end which is proximate to the bottom 190, into an annular bead 196 that surrounds an annular groove on its inner side. The outside diameter of the annular bead 196 somewhat larger than the outside diameter of the side wall 19*b*".

The annular bead 196 encloses the ring 180, that incorporates an upper ring section 198 as well as a lower ring section 200. The upper ring section 198 incorporates a projection 202 on its inner side that is proximate to a midline axis of the ring 180, this projection 202 serves as a "thread", which comes to rest beneath the thread extension 186 when the screw cap 182 is screwed onto the container 184. The projection 202 here forms the "thread" of the screw cap 182, the cap 188 having no threads of any sort on its side wall 196.

There is at least one projection on the inner side of the ring; the embodiment shown here incorporates three projections 202 that are spaced equidistantly on the perimeter of the screw cap 182.

It can be seen from the drawing that the upper ring section 198 incorporates an annular bead 206, that lies in the annular groove of the cap 188 that is enclosed by the annular bead 196. The annular bead 206 does not need to be continuous; it is also possible to arrange bead segments on the outer side of the upper ring element.

The upper ring element 198 continues in the direction of the bottom 190 of the cap 188 in a detent projection 208 which in this embodiment is configured as a continuous annular casing. This serves to center the screw cap 182 on the container 184. In addition, it prevents any direct contact between the cap 188 with the container 184, and thus reduces the frictional forces when the screw cap is screwed on or screwed off.

The lower ring section 200 also incorporates an annular bead 210, that is arranged in the annular groove that is enclosed by the annular bead 196 of the cap 188.

The height of the annular bead 196 or of the annular groove is so matched to the height of the annular bead of the upper ring section 198 and of the lower ring section 200 that these are securely enclosed. When this is done, the annular bead 206 of the upper ring element 198 is adjacent to an upper limiting wall 212 of the annular groove and the lower limiting wall of the annular bead 210 of the lower ring element 200 on a lower limiting wall 214 of the annular groove. The lower limiting wall 214 can be formed by beading the cap 188 whilst a ring is already installed in the cap. However, it is also possible to perform the annular groove and then let the ring snap into this annular groove.

A safety ring 216 is connected to the lower ring section 200, there being a nominal break line or a weakened line incorporated between these two parts. This can consist of a wall of thinner material although it can also consist of individual tear tags (not shown herein). On the outer side of the container 184 beneath the safety ring 216, as viewed from the midline axis 204, there is a safety bead 220 that is oriented outwards and which protects the safety ring against unintentional damage as well as against manipulation. The safety ring 216 is also protected in that the outside diameter of the annular bead 196 is greater than the outside diameter of the sealing ring. This, too, avoids unintentional damage.

A plurality of tabs 222 extend from the inner side of the safety ring that is proximate to the midline axis 204 and these lie elastically against the outer side of the container 184. In the area of the safety ring 218 or of these tabs 222 , this container has on its outer side at least one and preferably a plurality of detent projections 224 in which the tabs 222 can engage.

A first annular ring wall 226 extends obliquely outwards at an angle from a lower side 228 of the upper ring section 198, and this is provided with form-fit means. In the same way, a second annular wall 230 extends at an angle inwards from an upper side 232 of the lower ring section 200 and this, in turn, incorporates form-fit means, e.g., teeth or grooves. A reverse configuration of the ring elements is also possible.

The form-fit means that are incorporated on the annular walls 226 and 230 engage in each other so that no relative movement or rotation of the upper ring element 198 towards the lower ring element 200 is possible.

FIG. 20 shows the screw cap 182 shown in FIG. 19 on a container, in partial cross section. In FIGS. 19 and 20, identical parts bear identical reference numbers. FIG. 20 shows once again the tabs 222 that extend from the safety ring 216 in the direction of the midline axis 204 of the screw cap. The width of the tabs 222 corresponds in this embodiment to the height of the safety ring 216. It grows smaller in the direction of the end that is opposite to the origin of the tabs 222. Thus, the upper edges of the tabs 222 all lie in one plane. The upper edge of the safety ring 216 also lies in this plane.

The outer shape of the screw cap 182 shown in FIGS. 19 and 20 can be as desired. The annular bead 196 can be dispensed with. In this place of this, it is sufficient to incorporate the lower limit wall projection 214 (see FIG. 19), that extends inwards, in order to secure the ring 180 securely in the cap 188.

In place of the metal cap, it is possible to use a plastic cap, when the material should be relatively rigid. The attachment of the ring in a plastic cap can be effected by any known method. The ring can snap into the plastic cap. It is also possible to so form the lower edge of the plastic cap after insertion of the ring, using a cold-forming method, that individual projections or a continuous bead result, which then secure the ring in the cap.

If the cap is produced from plastic, it is possible to configure the blocking element as a part of said cap. Then, by way of example, teeth can be incorporated in the transition area between the bottom and the side wall of the plastic cap, and corresponding teeth of the detent projection of the ring then engage in these first teeth. But here, too, it is also possible to apply frictional force on the basis of contact forces alone, which then precludes any rotation of the ring relative to the cap. In this case, there is no requirement for any teeth.

From what has been said above, it can be seen that because of the detent projection that extends from the base body or from the upper ring section of the safety ring, which engages with a blocking element in the transition area between the bottom side of the cap, for all practical purposes any rotation of the cap relative to the ring is precluded. When the cap and the ring are joined, large frictional forces or a force or form-fit are generated so that the unit that is made up of the ring and the cap, the screw cap, can be screwed safely off the container. Even if the ring is configured as a so-called safety ring and the forces that are required to snap off the safety ring have to be applied additionally by a rotation of the cap, effective transfer of the rotational forces is ensured.

The transfer of the forces that is required to open the screw cap can also be ensured in that the detent projections are cemented or welded to the blocking element.

In place of an individual projection on the ring, it is possible to incorporate projecting areas that serve as a tread or else a continuous "thread".

We claim:

1. A screw cap for a container that has a thread, comprising:

a ring having a first projection held by a recess formed in the screw cap and a second projection that engages the thread of the container, wherein the ring incorporates an upper first ring element that bears the first and second projections and a lower second ring element on which a safety ring is installed, wherein the upper and lower ring elements are configured as separate rings, and wherein the upper ring element and the lower ring element are joined to each other by one of friction, shape fit, welding, and adhesion.

2. A screw cap as defined in claim 1, wherein the shape fit means comprises members formed on the first and second ring elements for preventing rotation of one of the ring elements relative to the other ring element.

3. A screw cap for a container that has a thread, comprising:

a ring having a first projection held by a recess formed in the screw cap and a second projection that engages the thread of the container, wherein the ring includes a safety ring, at least one area of which remains permanently deformed when the container is first opened, wherein the ring incorporates an upper first ring element that bears the first and second projections and a lower second ring element on which the safety ring is installed, wherein the upper and lower ring elements are configured as separate rings, and wherein the upper ring element has one of protuberances and depressions on an underside thereof that works in conjunctional with on e protuberances and depression on an upper side of the lower ring element to prevent relative rotation of the upper first ring element and the lower second ring element.

4. A screw cap for a container that has a thread, comprising:

a ring having a first projection held by a recess formed in the screw cap and a second projection that engages the thread of the container, wherein the ring includes a safety ring, at least one area of which remains permanently deformed when the container is first opened, wherein the ring incorporates an upper first ring element that bears the first and second projections and a lower second ring element on which the safety ring is installed, wherein the upper and the lower ring elements are configured as separate rings, wherein on one ring element there is a first annular wall that has a first member on an inner side thereof, and on the other ring element their is a second annular wall with a second member on an outer side thereof, and wherein an inside diameter of the first annular wall is so matched to an a outside diameter of the second annular wall that the first and second members engage each other.

5. A screw cap as defined in claim 4, wherein the first and second annular walls are conical.

6. A screw cap for a container that has a thread, comprising:

a ring having a first projection held by a recess formed in the screw cap and a second projection that engages the thread of the container, wherein the ring includes a safety ring, at least one area of which remains permanently deformed when the container is first opened, wherein the ring incorporates an upper first ring element that bears the first and second projections and a lower second ring element on which the safety ring is installed, wherein the upper and the lower ring elements are configured as separate rings, wherein on one ring element there is a first annular wall that has a first member on an inner side thereof, and on the other ring element there is a second annular wall with a second member on an outer side thereof, and wherein an inside diameter of the first annular wall is so matched to an outside diameter of the second annular wall that the first and second members engage each other, and wherein the first and second members incorporate saw-toothed protuberances.

7. A screw cap as defined in claim 6, wherein the first and second projections on the first ring element incorporate stop surfaces that are oriented in a clockwise direction, and on the second ring element there are stop surfaces that are oriented so as to be counter-clockwise, so that the rotation of the first and second ring elements in opposite directions is prevented, in at least one direction.

* * * * *

UNITED STATES PATENT AND TRADEMARK OFFICE

CERTIFICATE OF CORRECTION

PATENT NO. : 5,255,805

DATED : October 26, 1993

INVENTOR(S) : Jürgen Weiss et al.

It is certified that error appears in the above-indentified patent and that said Letters Patent is hereby corrected as shown below:

Col. 1, line 2, delete first "," and substitute --. More--.

Col. 2, line 28, delete "configures" and substitute --configured--.

Col. 5, line 46, delete "is" and substitute --15--.

Col. 6, line 33, delete "5".

Col. 8, line 49, after "ring" insert --11--; and line 67, delete "containers" and substitute --container--.

Col. 9, line 19, after "cap" insert --element--;

line 32, after "19" insert --,--;

line 35, after "screw" insert --cap-- and line 55, after "element" insert --56--.

Col. 10, line 6, after "element" insert --56--.

UNITED STATES PATENT AND TRADEMARK OFFICE

CERTIFICATE OF CORRECTION

PATENT NO. : 5,255,805

DATED : October 26, 1993

INVENTOR(S) : Jürgen Weiss et al.

It is certified that error appears in the above-indentified patent and that said Letters Patent is hereby corrected as shown below:

Col. 11, line 43, after "absorbed" insert --and--; and line 49, delete "partial" and substitute --practical--.

Col. 12, line 43, delete "piece" and substitute --piece 90--.

Col. 13, line 49, delete "150" and substitute --50--;

line 53, delete ",";

line 62, after "66" insert --, 68--; and line 64, delete ",".

UNITED STATES PATENT AND TRADEMARK OFFICE

CERTIFICATE OF CORRECTION

PATENT NO. : 5,255,805

DATED : October 26, 1993

INVENTOR(S) : Jürgen Weiss et al.

It is certified that error appears in the above-indentified patent and that said Letters Patent is hereby corrected as shown below:

Col. 14, lines 2 and 3, delete "t";

line 7, delete "tt";

line 38, delete "tt" and after "element" insert --56--;

line 41, delete "tt";

line 42, after "pieces" insert --90--;

line 45, after "pieces" insert --90--;

line 48, after "52" insert --,--;

line 49, after "pieces" insert --90--;

line 52, delete "bridges" and substitute --bridge--;

line 59, after "depressions" insert --92--; and line 68, delete "54" and substitute --50--.

UNITED STATES PATENT AND TRADEMARK OFFICE

CERTIFICATE OF CORRECTION

PATENT NO. : 5,255,805

DATED : October 26, 1993

INVENTOR(S) : Jürgen Weiss et al.

It is certified that error appears in the above-indentified patent and that said Letters Patent is hereby corrected as shown below:

Col. 15, line 3, delete "t";

line 16, delete "tt";

line 23, delete "t" and substitute --being--;

line 47, delete "tt"; and line 63, after "casing" insert --,--.

Col. 16, line 16, after "122" insert --of--, and delete "tt".

line 42, after "148" insert --,--;

line 59, after "172" insert --,--; and line 67, after "projection" insert --172--.

Col. 17, line 26, after "end" insert --,--; and line 30, before "somewhat" insert --is--.

UNITED STATES PATENT AND TRADEMARK OFFICE

CERTIFICATE OF CORRECTION

PATENT NO. : 5,255,805

DATED : October 26, 1993

INVENTOR(S) : Jürgen Weiss et al.

It is certified that error appears in the above-indentified patent and that said Letters Patent is hereby corrected as shown below:

Col. 18, line 13, after "184" insert --,--;

line 24, delete "218" and substitute --216--; and line 25, after "222" delete space.

Col. 19, line 27, delete "tread" and insert --thread-- line 63, delete "conjunctional" and substitute --conjunction--, and delete "on e" and substitute --one of--.

Col. 20, line 1, delete "depression" and substitute --depressions--; and line 25, delete "a".

UNITED STATES PATENT AND TRADEMARK OFFICE

CERTIFICATE OF CORRECTION

PATENT NO. : 5,255,805

DATED : October 26, 1993

INVENTOR(S) : Jürgen Weiss et al.

It is certified that error appears in the above-indentified patent and that said Letters Patent is hereby corrected as shown below:

Column 14, line 33, "H" should be deleted.
line 40, "t" should be deleted.

Signed and Sealed this

Sixth Day of December, 1994

Bruce Lehman

*Attest:*

BRUCE LEHMAN

*Attesting Officer*

*Commissioner of Patents and Trademarks*